US007837061B2

(12) United States Patent
Dummer et al.

(10) Patent No.: US 7,837,061 B2
(45) Date of Patent: Nov. 23, 2010

(54) METHODS AND APPARATUS FOR DISPENSING SOLID PHARMACEUTICAL ARTICLES

(75) Inventors: Andrew Kirk Dummer, Chapel Hill, NC (US); Bryan Patrick Farnsworth, Wake Forest, NC (US); Richard D. Michelli, Raleigh, NC (US); Jeffrey P. Williams, Hillsborough, NC (US); David Alan Calderwood, Chapel Hill, NC (US)

(73) Assignee: PARATA Systems, LLC, Durham, NC (US)

( * ) Notice: Subject to any disclaimer, the term of this patent is extended or adjusted under 35 U.S.C. 154(b) by 349 days.

(21) Appl. No.: 11/750,710

(22) Filed: May 18, 2007

(65) Prior Publication Data

US 2008/0283549 A1 Nov. 20, 2008

(51) Int. Cl.
*G07F 11/00* (2006.01)

(52) U.S. Cl. ..... 221/278; 221/174

(58) Field of Classification Search ..... 221/1, 221/9, 278

See application file for complete search history.

(56) References Cited

U.S. PATENT DOCUMENTS 2,578,369 A * 12/1951 Noelcke, Sr. ..... 119/53.5
2,665,775 A 1/1954 Smith
2,708,996 A 5/1955 Skillman
2,865,532 A 12/1958 Smith
3,023,851 A 3/1962 Stiller
3,144,958 A 8/1964 Gumpertz
3,160,793 A 12/1964 Colburn
3,179,288 A 4/1965 Davy
3,185,851 A 5/1965 D'Emilio
3,196,276 A 7/1965 Naab
3,206,062 A 9/1965 Rappaport
3,310,199 A 3/1967 Roberts
3,312,372 A 4/1967 Cooper, Jr.
3,410,450 A 11/1968 Fortenberry (Continued)

FOREIGN PATENT DOCUMENTS

CA 936 501 11/1973

(Continued)

OTHER PUBLICATIONS

International Search Report and Written Opinion corresponding to International Application No. PCT/US2008/005197, Mailing Date Aug. 13, 2008, (13 Pages).

*Primary Examiner*—Gene Crawford
*Assistant Examiner*—Kelvin L Randall, Jr.
(74) *Attorney, Agent, or Firm*—Myers Bigel Sibley & Sajovec, PA

(57) ABSTRACT

An apparatus for dispensing pharmaceutical articles includes a housing and a gas source to provide a positive pressure supply gas flow. The housing defines a hopper chamber to hold the articles, a dispensing channel fluidly connected to the hopper chamber, a drive jet outlet, and an agitation outlet. The dispensing channel has an inlet and an outlet and defines a flow path therebetween. The gas source is fluidly connected to each of the drive jet outlet and the agitation outlet to provide: a pressurized drive jet gas flow through the drive jet outlet to convey articles through the dispensing channel along the flow path; and a pressurized agitation gas flow through the agitation outlet to agitate articles in the hopper chamber.

30 Claims, 13 Drawing Sheets

U.S. PATENT DOCUMENTS

| | | | | | |
|---|---|---|---|---|---|
| 3,417,542 | A | | 12/1968 | Merrill | |
| 3,436,736 | A | | 4/1969 | Platt | |
| 3,556,342 | A | | 1/1971 | Guarr | |
| 3,599,152 | A | | 8/1971 | Williams | |
| 3,653,176 | A | | 4/1972 | Gess | |
| 3,730,388 | A | | 5/1973 | Bender | |
| 3,732,544 | A | | 5/1973 | Obland | |
| 3,780,907 | A | | 12/1973 | Colburn | |
| 3,815,780 | A | | 6/1974 | Bauer | |
| 3,837,139 | A | | 9/1974 | Roseberg | |
| 3,885,702 | A | | 5/1975 | Joslin | |
| 3,917,045 | A | | 11/1975 | Williams | |
| 4,223,751 | A | | 9/1980 | Ayers et al. | |
| 4,267,942 | A | | 5/1981 | Wick | |
| 4,434,602 | A | | 3/1984 | Culpepper | |
| 4,546,901 | A | | 10/1985 | Buttarazzi | |
| 4,548,336 | A | * | 10/1985 | Dove | 221/203 |
| 4,573,606 | A | | 3/1986 | Lewis | |
| 4,655,026 | A | | 4/1987 | Wigoda | |
| 4,664,289 | A | | 5/1987 | Shimizu | |
| 4,674,259 | A | | 6/1987 | Hills | |
| 4,674,651 | A | | 6/1987 | Scidmore | |
| 4,693,057 | A | | 9/1987 | Rittinger | |
| 4,695,954 | A | | 9/1987 | Rose | |
| 4,741,428 | A | * | 5/1988 | Taniguchi et al. | 198/397.04 |
| 4,766,542 | A | | 8/1988 | Pilarczyk | |
| 4,767,023 | A | | 8/1988 | Hackmann | |
| 4,801,044 | A | | 1/1989 | Kubota et al. | |
| 4,805,377 | A | | 2/1989 | Carter | |
| 4,869,392 | A | | 9/1989 | Moulding, Jr. | |
| 4,913,315 | A | * | 4/1990 | Wagner | 221/200 |
| 4,918,604 | A | | 4/1990 | Baum | |
| 4,953,749 | A | * | 9/1990 | Kubota et al. | 221/168 |
| 4,971,513 | A | | 11/1990 | Bergerioux | |
| 4,980,292 | A | | 12/1990 | Elbert | |
| 4,984,709 | A | | 1/1991 | Weinstein | |
| 5,018,644 | A | | 5/1991 | Hackmann | |
| 5,047,948 | A | | 9/1991 | Turner | |
| 5,289,921 | A | * | 3/1994 | Rodrigo et al. | 209/3 |
| 5,337,919 | A | | 8/1994 | Spaulding et al. | |
| 5,385,434 | A | | 1/1995 | Quinn et al. | |
| 6,003,753 | A | * | 12/1999 | Hwang et al. | 228/41 |
| 6,006,946 | A | | 12/1999 | Williams et al. | |
| 6,036,812 | A | | 3/2000 | Williams et al. | |
| 6,039,512 | A | | 3/2000 | Chooi et al. | |
| 6,116,821 | A | * | 9/2000 | Teoh et al. | 406/137 |
| 6,176,392 | B1 | | 1/2001 | Williams et al. | |
| RE37,829 | E | | 9/2002 | Charhut | |
| 6,443,326 | B1 | | 9/2002 | Saito et al. | |
| 6,484,902 | B1 | * | 11/2002 | Rouse | 221/278 |
| 6,631,826 | B2 | * | 10/2003 | Pollard et al. | 221/156 |
| 6,736,286 | B2 | | 5/2004 | Hashimoto et al. | |
| 6,971,541 | B2 | | 12/2005 | Williams et al. | |
| 2004/0004085 | A1 | * | 1/2004 | Williams et al. | 221/278 |
| 2004/0159669 | A1 | * | 8/2004 | Pollard et al. | 221/278 |
| 2006/0006189 | A1 | * | 1/2006 | Curtolo et al. | 221/178 |
| 2006/0006190 | A1 | | 1/2006 | Janet et al. | |
| 2006/0241807 | A1 | | 10/2006 | Daniels et al. | |

FOREIGN PATENT DOCUMENTS

| | | | |
|---|---|---|---|
| GB | 1 168 758 | | 10/1969 |
| GB | 1 411 951 | | 10/1975 |
| GB | 2 244 481 | A | 12/1991 |
| JP | 51-000792 | B | 1/1976 |
| JP | 52-047400 | | 4/1977 |
| JP | 61-104904 | | 5/1986 |
| JP | 63-208410 | | 8/1988 |
| JP | 64-028102 | | 1/1989 |
| JP | 1-288265 | | 11/1989 |
| JP | 2-028417 | | 1/1990 |

* cited by examiner

METHODS AND APPARATUS FOR DISPENSING SOLID PHARMACEUTICAL ARTICLES

FIELD OF THE INVENTION

The present invention is directed generally to the dispensing of solid pharmaceutical articles and, more specifically, is directed to the automated dispensing of solid pharmaceutical articles.

BACKGROUND OF THE INVENTION

Pharmacy generally began with the compounding of medicines which entailed the actual mixing and preparing of medications. Heretofore, pharmacy has been, to a great extent, a profession of dispensing, that is, the pouring, counting, and labeling of a prescription, and subsequently transferring the dispensed medication to the patient. Because of the repetitiveness of many of the pharmacist's tasks, automation of these tasks has been desirable.

Some attempts have been made to automate the pharmacy environment. Different exemplary approaches are shown in U.S. Pat. No. 5,337,919 to Spaulding et al. and U.S. Pat. Nos. 6,006,946; 6,036,812 and 6,176,392 to Williams et al. These systems utilize robotic arms to grasp a container, carry it to one of a number of bins containing tablets (from which a designated number of tablets are dispensed), carry it to a printer, where a prescription label is applied, and release the filled container in a desired location. Tablets are counted and dispensed with any number of counting devices. Drawbacks to these systems typically include the relatively low speed at which prescriptions are filled and the absence in these systems of securing a closure (i.e., a lid) on the container after it is filled.

One automated system for dispensing pharmaceuticals is described in some detail in U.S. Pat. No. 6,971,541 to Williams et al. This system has the capacity to select an appropriate vial, label the vial, fill the vial with a desired quantity of a selected pharmaceutical tablet, apply a cap to the filled vial, and convey the labeled, filled, capped vial to an offloading station for retrieval. Although this particular system can provide automated pharmaceutical dispensing, it may be desirable to modify certain aspects of the system to address particular needs.

SUMMARY OF THE INVENTION

According to embodiments of the present invention, an apparatus for dispensing pharmaceutical articles includes a housing and a gas source to provide a positive pressure supply gas flow. The housing defines a hopper chamber to hold the articles, a dispensing channel fluidly connected to the hopper chamber, a drive jet outlet, and an agitation outlet. The dispensing channel has an inlet and an outlet and defines a flow path therebetween. The gas source is fluidly connected to each of the drive jet outlet and the agitation outlet to provide: a pressurized drive jet gas flow through the drive jet outlet to convey articles through the dispensing channel along the flow path; and a pressurized agitation gas flow through the agitation outlet to agitate articles in the hopper chamber.

According to some embodiments, the agitation gas flow has a greater mass flow rate than the drive jet gas flow. According to some embodiments, the agitation gas flow has a greater mass flow rate than the supply gas flow. According to some embodiments, an air amplifier is interposed and fluidly connected between the gas source and the agitation outlet. The air amplifier may be configured to utilize the Coanda Effect.

According to method embodiments of the present invention, a method is provided for dispensing pharmaceutical articles using an apparatus including a housing defining a hopper chamber to hold the articles, a dispensing channel fluidly connected to the hopper chamber, a drive jet outlet, and an agitation outlet, the dispensing channel having an inlet and an outlet and defining a flow path therebetween, the apparatus further including a gas source fluidly connected to each of the drive jet outlet and the agitation outlet. The method includes providing a positive pressure supply gas flow from the gas source to each of the drive jet outlet and the agitation outlet to generate each of a pressurized drive jet gas flow through the drive jet outlet and a pressurized agitation gas flow through the agitation outlet. The drive jet gas flow conveys articles through the dispensing channel along the flow path and the agitation gas flow agitates articles in the hopper chamber.

According to some embodiments, the agitation gas flow has a greater mass flow rate than the drive jet gas flow. According to some embodiments, the agitation gas flow has a greater mass flow rate than the supply gas flow. According to some embodiments, the supply gas flow is provided from the gas source to the agitation outlet via an air amplifier interposed and fluidly connected between the gas source and the agitation outlet. The air amplifier may be configured to utilize the Coanda Effect.

According to further embodiments of the present invention, an apparatus for dispensing pharmaceutical articles includes a dispensing channel having an inlet and an outlet and defining a flow path therebetween, and a housing defining a hopper chamber to hold the articles. The hopper chamber is in fluid communication with the inlet of the dispensing channel. The housing includes a floor and a divider wall configured to define, in the hopper chamber: a front region between the inlet and the divider wall; a rear region on a side of the divider wall opposite the front region; and a choke passage between the front and rear regions and between the divider wall and the floor. According to some embodiments, a spacing between the divider wall and the floor is adjustable to adjust the size of the choke passage.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
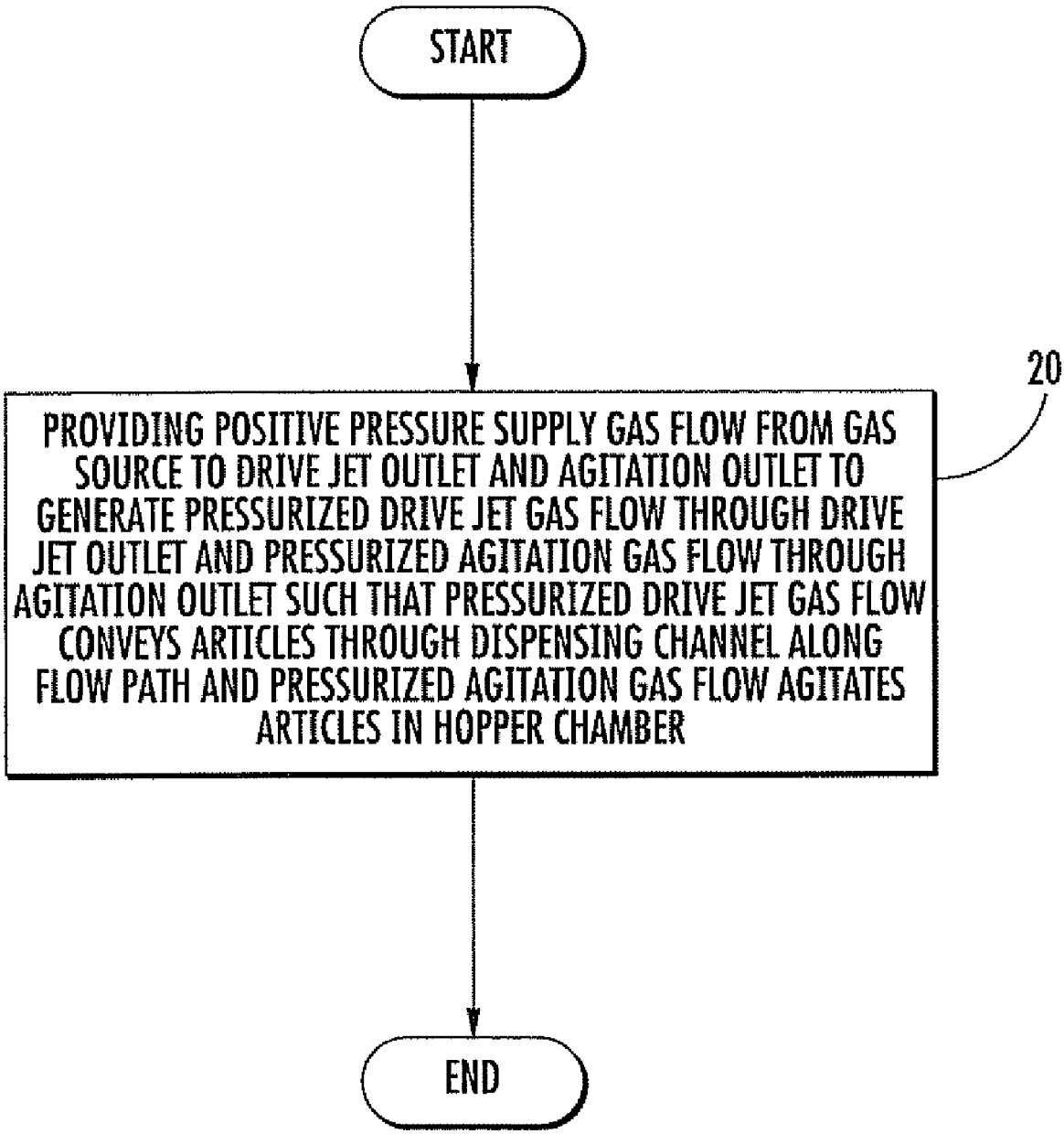
FIG. 1 is a flow chart illustrating methods according to embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In accordance with embodiments of the present invention, apparatus and methods are provided for dispensing solid pharmaceutical articles. In particular, such methods and apparatus may be used to dispense pharmaceuticals. With reference to FIG. 1, methods according to embodiments of the present invention may be executed using an apparatus including a housing defining a hopper chamber to hold the articles, a dispensing channel fluidly connected to the hopper chamber, a drive jet outlet, and an agitation outlet, the dispensing channel having an inlet and an outlet and defining a flow path therebetween, the apparatus further including a gas source fluidly connected to each of the drive jet outlet and the agitation outlet. A positive pressure supply gas flow is provided from the gas source to each of the drive jet outlet and the agitation outlet to generate each of a pressurized drive jet gas flow through the drive jet outlet and a pressurized agitation gas flow through the agitation outlet such that the pressurized drive jet gas flow conveys articles through the dispensing channel along the flow path and the pressurized agitation gas flow agitates articles in the hopper chamber (Block 20). According to some embodiments, the articles are pharmaceutical tablets or pills.

According to some embodiments, the agitation gas flow has a higher or greater mass flow rate than the drive jet gas flow. According to some embodiments, the agitation gas flow has a greater mass flow rate than the supply gas flow. The supply gas flow may be provided from the gas source to the agitation outlet via an air amplifier interposed and fluidly connected between the gas source and the agitation outlet. According to some embodiments, the drive jet outlet and the agitation outlet are supplied by the same as source. According to some embodiments, the drive jet gas flow and the agitation gas flow are provided simultaneously. The air amplifier may be configured to utilize the Coanda Effect.

Figure 2:
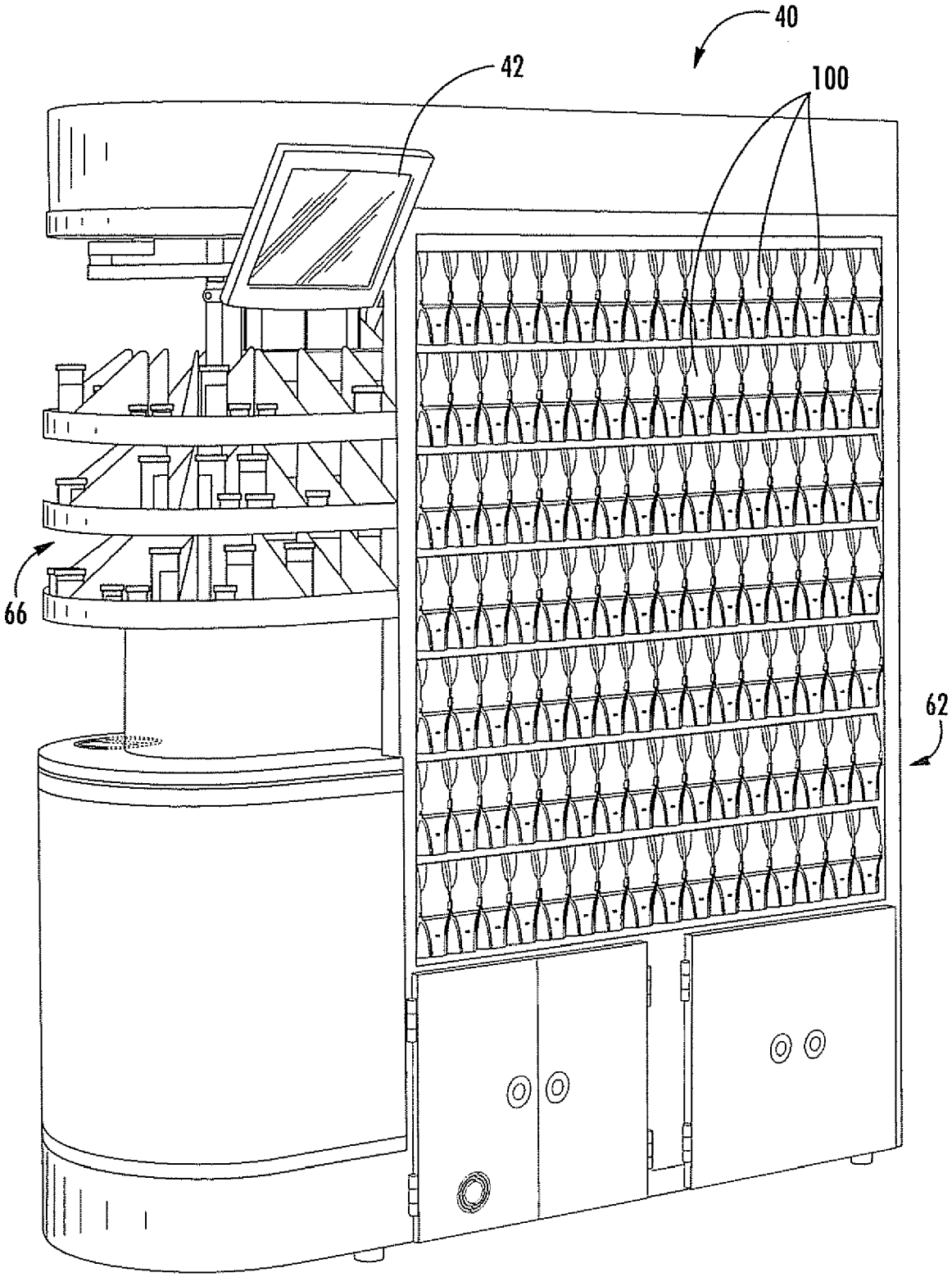
FIG. 2 is a perspective view of a pharmaceutical tablet dispensing system including a sensor clearing system according to embodiments of the present invention.
Figure 3:
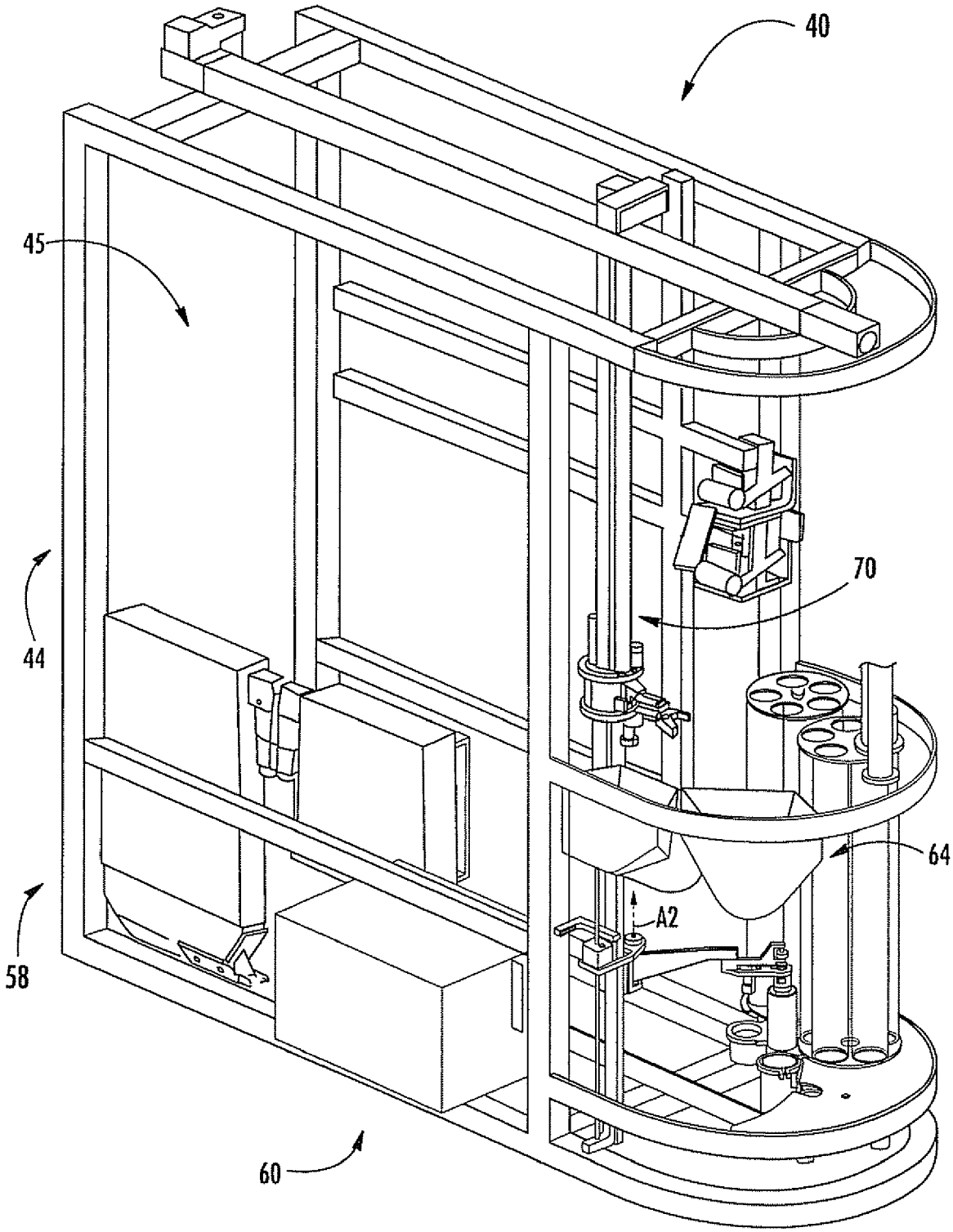
FIG. 3 is a cutaway view of the tablet dispensing system of FIG. 2 illustrating a container dispensing station, a labeling carrier, a dispensing carrier, and a closure dispensing station thereof.

A dispensing system according to embodiments of the present invention and that can carry out the foregoing methods is illustrated in FIGS. 2-13 and designated broadly therein at 40 (FIGS. 2 and 3). The system 40 includes a support frame 44 for the mounting of its various components. Those skilled in this art will recognize that the frame 44 illustrated herein is exemplary and can take many configurations that would be suitable for use with the present invention. The frame 44 provides a strong, rigid foundation to which other components can be attached at desired locations, and other frame forms able to serve this purpose may also be acceptable for use with this invention.

The system 40 generally includes as operative stations a controller (represented herein by a graphics user interface 42), a container dispensing station 58, a labeling station 60, a tablet dispensing station 62, a closure dispensing station 64, and an offloading station 66. In the illustrated embodiment, containers, tablets and closures are moved between these stations with a dispensing carrier 70; however, in some embodiments, multiple carriers are employed. The dispensing carrier 70 has the capability of moving the container to designated locations within the cavity 45 of the frame 44. Except as discussed herein with regard to the dispensing station 62, each of the operative stations and the conveying devices may be of any suitable construction such as those described in detail in U.S. Pat. No. 6,971,541 to Williams et al. and/or U.S. Patent Publication No. US-2006-0241807-A1, the disclosures of which are hereby incorporated herein in their entireties.

The controller 42 controls the operation of the remainder of the system 40. In some embodiments, the controller 42 will be operatively connected with an external device, such as a personal or mainframe computer, that provides input information regarding prescriptions. In other embodiments, the controller 42 may include a stand-alone computer that directly receives manual input from a pharmacist or other operator. An exemplary controller may include a conventional microprocessor-based personal computer. The controller 42 may be a centralized computer or portions thereof may be physically and/or functionally distributed or divided into multiple controllers. For example, according to some embodiments, the controller is embodied in part in each tablet dispensing bin assembly.

In operation, the controller 42 signals the container dispensing station 58 that a container of a specified size is desired. In response, the container dispensing station 58 delivers a container for retrieval by the carrier 70. From the container dispensing station 58, the container is moved to the labeling station 60 by the carrier 70. The labeling station 60 includes a printer that is controlled by the controller 42. The printer prints and presents an adhesive label that is affixed to the container.

Filling of labeled containers with tablets is carried out by the tablet dispensing station 62. The tablet dispensing station 62 comprises a plurality of tablet dispensing bin assemblies or bins 100 (described in more detail below), each of which holds a bulk supply of individual tablets (typically the bins 100 will hold different tablets). Referring to FIGS. 2 and 4-7, the dispensing bins 100, which may be substantially identical in size and configuration, are organized in an array mounted on the rails of the frame 44. Each dispensing bin 100 has a dispensing channel 116 with an outlet 116B (FIG. 7) that faces generally in the same direction, to create an access region for the dispensing carrier 70. The identity of the tablets in each bin is known by the controller 42, which can direct the dispensing carrier 70 to transport the container to the proper bin 100.

The dispensing bins 100 are configured to singulate, count, and dispense the tablets contained therein, with the operation of the bins 100 and the counting of the tablets being controlled by the controller 42. According to some embodiments, each bin 100 includes its own dedicated controller that is operative to execute a dispensing run upon receiving a command from a central controller or the like. Some embodiments may employ the controller 42 as the device which monitors the locations and contents of the bins 100; others may employ the controller 42 to monitor the locations of the bins, with the bins 100 including indicia (such as a bar code or electronic transmitter) to identify the contents to the controller 42. In still other embodiments, the bins 100 may generate and provide location and content information to a central controller, with the result that the bins 100 may be moved to different positions on the frame 44 without the need for manual modification of the central controller (i.e., the bins 100 will update the central controller automatically).

Any of a number of dispensing units that singulate and count discrete objects may be employed if suitably modified to include the inventive aspects disclosed herein. In particular, dispensing units that rely upon targeted air flow and a singulating nozzle assembly may be used, such as the devices described in U.S. Pat. No. 6,631,826 to Pollard et al. and/or U.S. Patent Publication No. US-2006-0241807-A1, each of which is hereby incorporated herein by reference in its entirety. Bins of this variety may also include additional features, such as those described below.

After the container is desirably filled by the tablet dispensing station 62, the dispensing carrier 70 moves the filled container to the closure dispensing station 64. The closure dispensing station 64 may house a bulk supply of closures and dispense and secure them onto a filled container. The dispensing carrier 70 then moves to the closed container, grasps it, and moves it to the offloading station 66.

Turning to the bins 100 in more detail, an exemplary bin 100 is shown in more detail in FIGS. 4-13. The bin 100 includes a housing 110 having a hopper portion 112 and a nozzle 114. The bin 100 is fluidly connected with a pressurized gas source 136 as discussed in more detail below.

Figure 6:
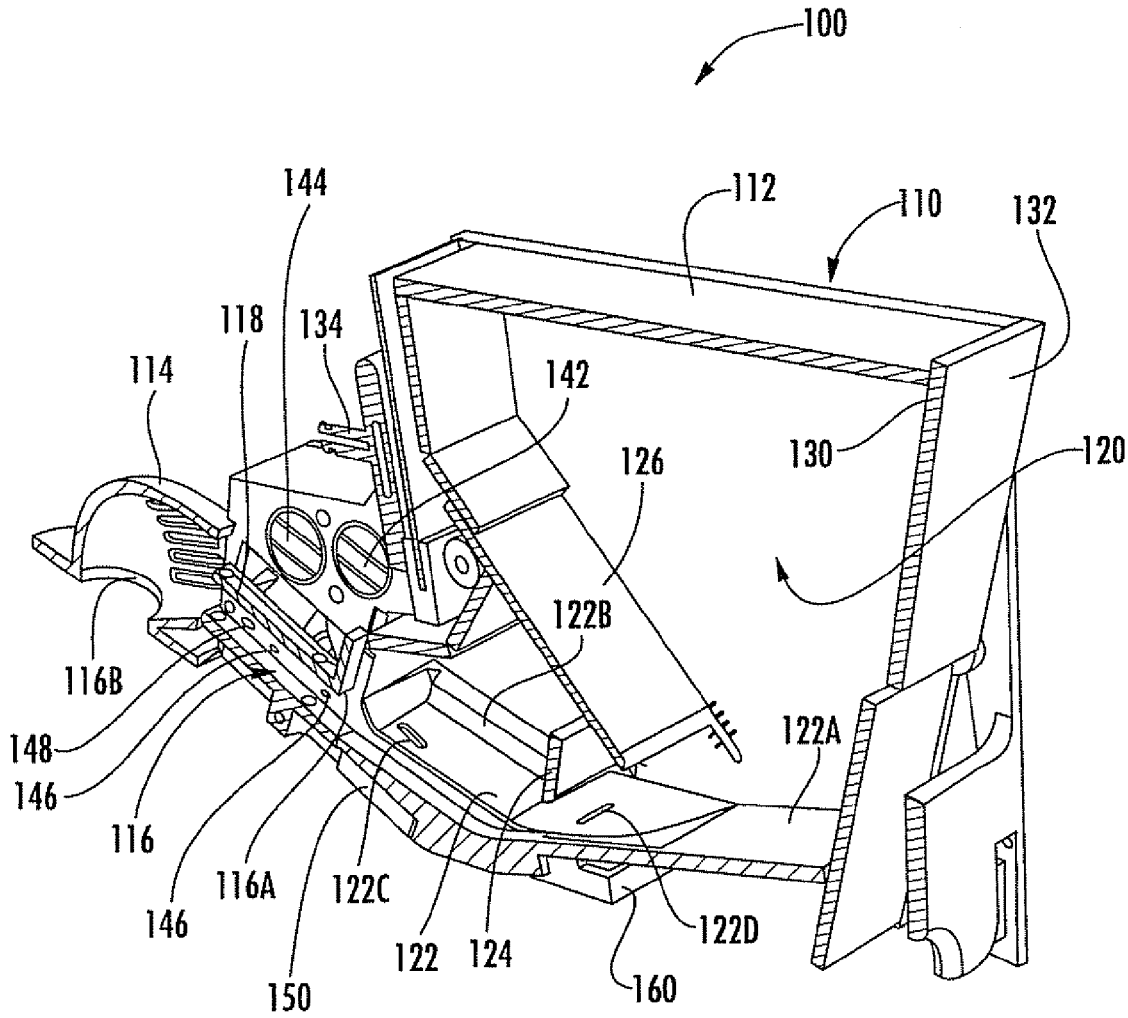
FIG. 6 is a cross-sectional, perspective view of the bin of FIG. 4.
Figure 7:
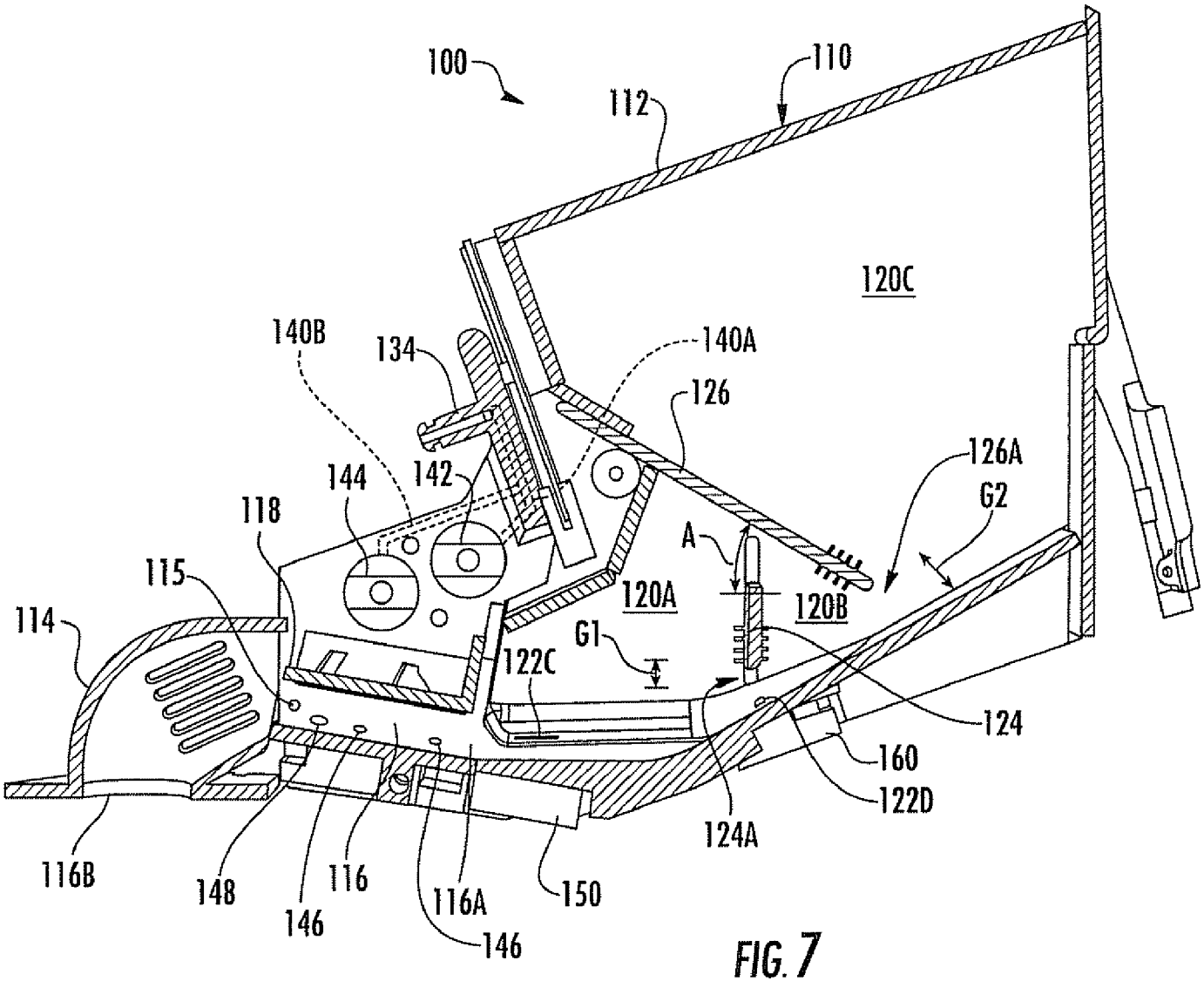
FIG. 7 is a cross-sectional view of the bin of FIG. 4.
Figure 8:
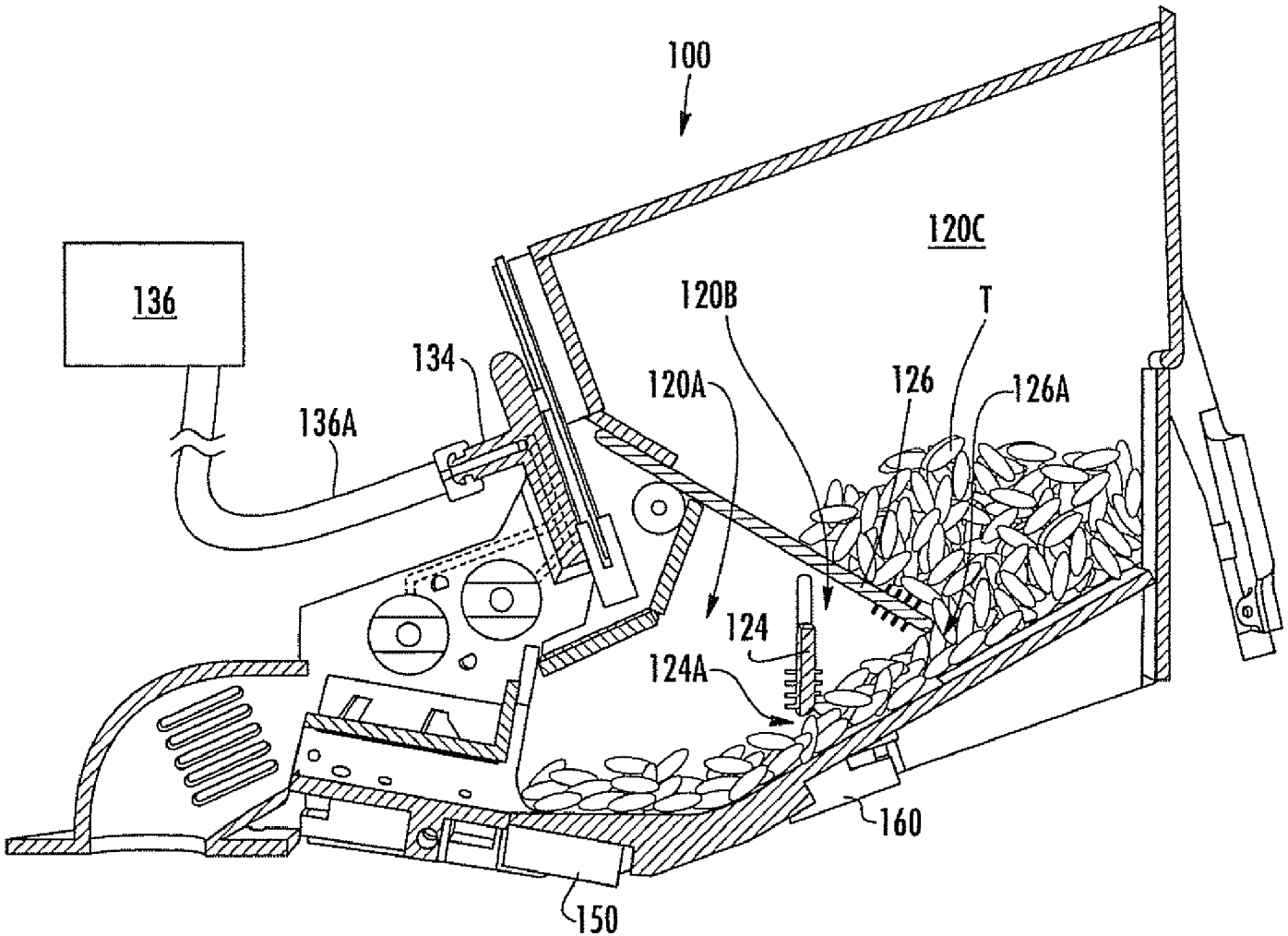
FIG. 8 is a cross-sectional view of the bin of FIG. 4 wherein tablets contained therein are at rest.

Referring to FIGS. 6-8, the hopper portion 112 defines a hopper chamber 120 that can be filled with tablets T (FIG. 8). The bin 100 can be filled or replenished with tablets through an opening 130 located at the upper rear portion of the bin 100. The opening 130 is selectively accessible via a pivoting door 132, for example.

Figure 9:
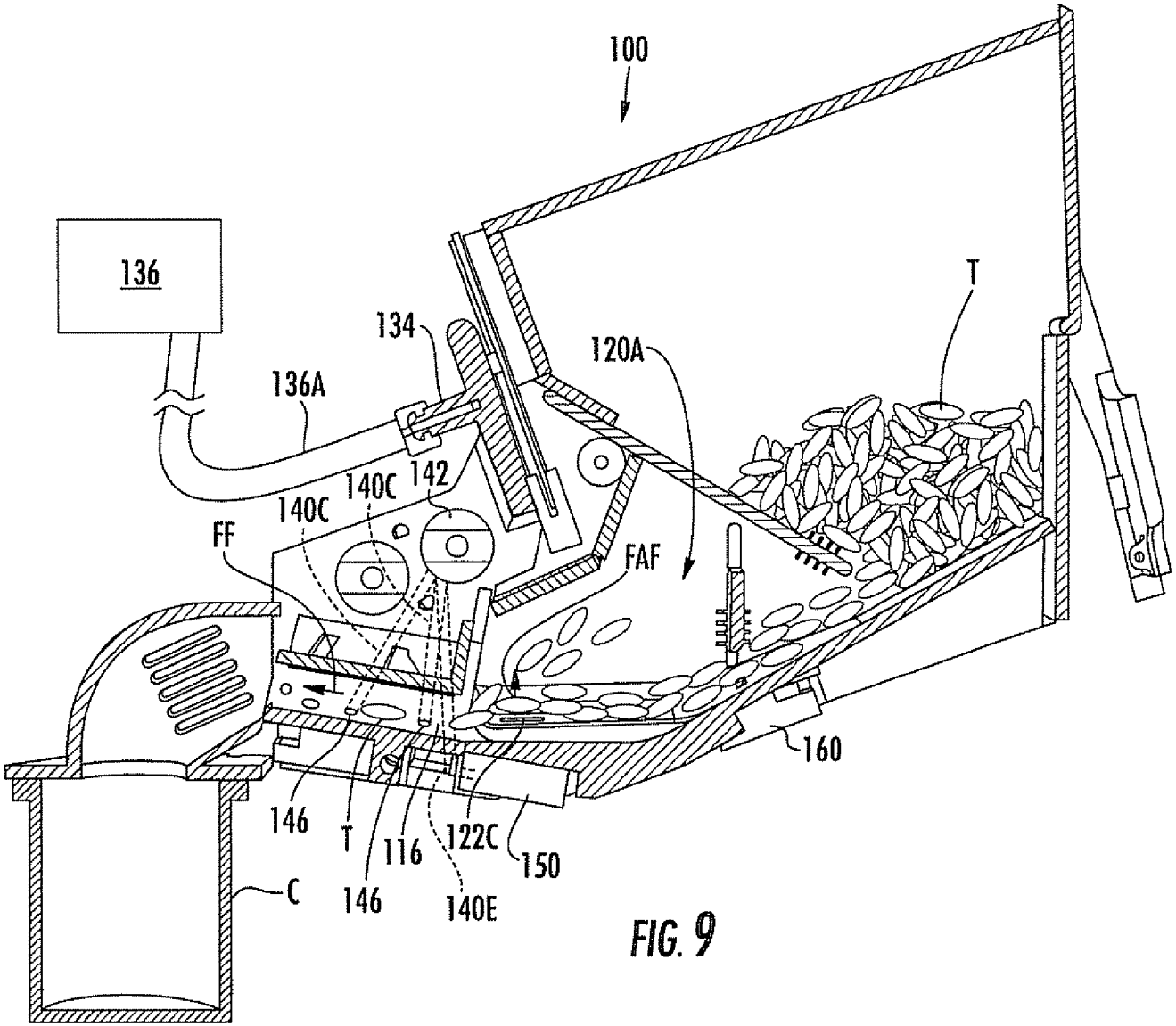
FIG. 9 is a cross-sectional view of the bin of FIG. 4 wherein tablets contained therein are being agitated and dispensed.
Figure 10:
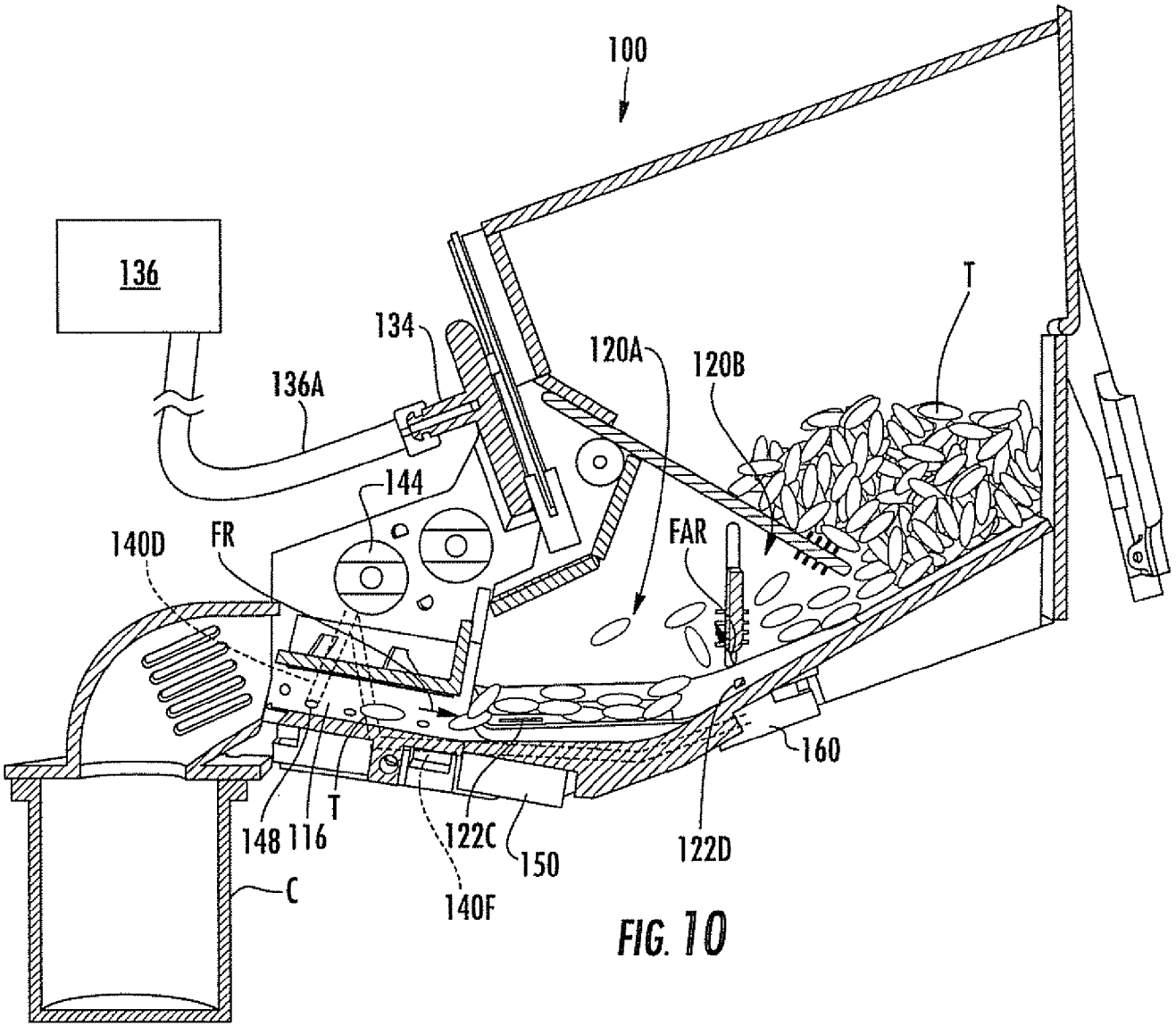
FIG. 10 is a cross-sectional view of the bin of FIG. 4 wherein tablets contained therein are being agitated and returned to a hopper chamber of the bin.

The nozzle 114 defines the dispensing channel 116 through which the tablets T can be dispensed one at a time into the container C, for example (FIGS. 9 and 10). The dispensing channel 116 has an inlet 116A opposite the outlet 116B and fluidly connects the channel 116 to the chamber 120. As disclosed in U.S. Patent Publication No. US-2006-0241807-A1, the bin 100 may include components that permit the entry to the dispensing channel 116 to be adjusted in size to complement the size and configuration of the tablet to be dispensed. For example, an upper wall 118 defining a portion of the dispensing passage 116 may be slidable up and down to selectively adjust the height of the passage 116 and/or the inlet 116A. A side wall may be similarly movable to adjust the width of the passage 116 and/or the inlet 116A.

With reference to FIG. 6, the hopper portion 112 has a bottom wall defining a floor 122. The floor 122 has a sloped rear portion 122A that slopes downwardly toward the inlet 116A. The floor 122 also has a funnel-shaped front portion 122B. A front agitation port or outlet 122C and a rear agitation port or outlet 122D are provided in the floor 122. As discussed below, air or other pressurized gas can be flowed through the outlets 122C, 122D and into the chamber 120 to agitate the tablets T contained therein.

Figure 4:
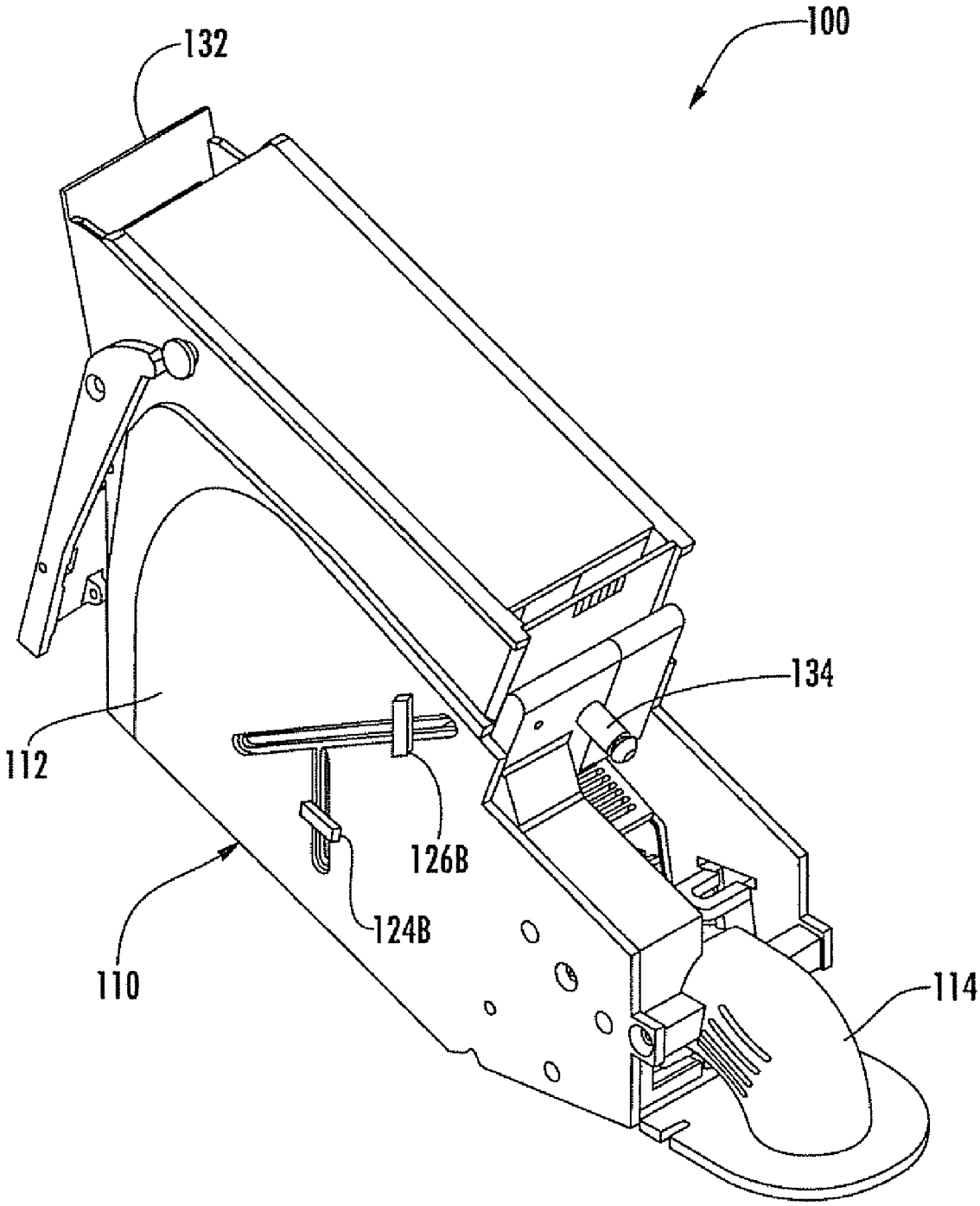
FIG. 4 is a top, front perspective view of a dispensing bin according to embodiments of the present invention.
Figure 5:
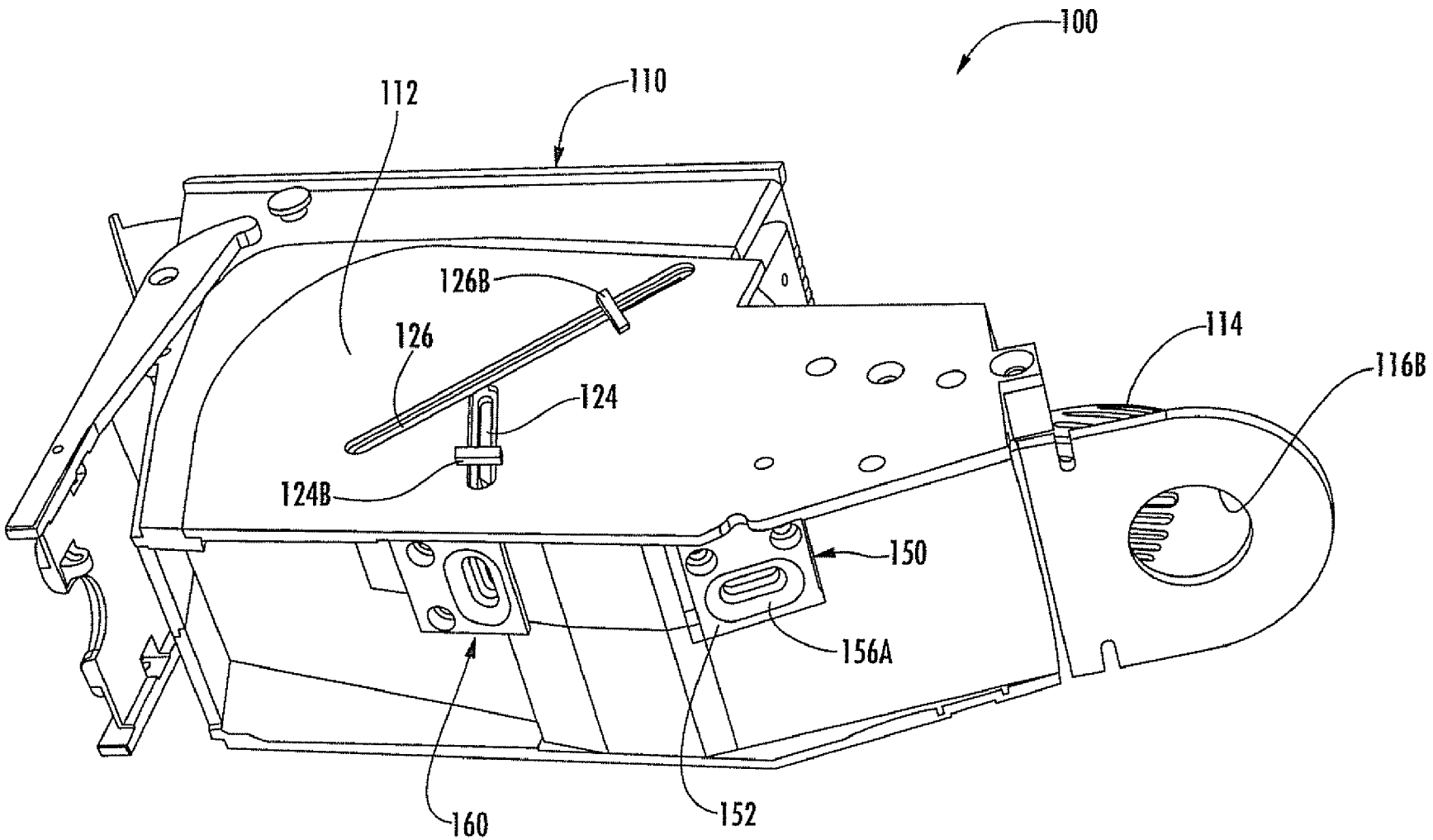
FIG. 5 is a bottom perspective view of the bin of FIG. 4.

With reference to FIG. 7, a front partition or divider wall 124 extends through the hopper chamber 120 and forms a gap or choke point 124A between the lower edge of the wall 124 and the floor 122. According to some embodiments, the choke point 124A has a gap spacing or height G1 (FIG. 7) of between about 0.25 and 0.75 inch. The position of the wall 124, and thereby the gap spacing G1, may be selectively adjusted using an adjustment mechanism 124B (FIG. 4).

A rear partition or divider wall 126 extends through the hopper chamber 120 and forms a gap or choke point 126A between the lower edge of the wall 126 and the floor 122. According to some embodiments, the choke point 126A has a gap spacing or height G2 (FIG. 7) of between about 0.6 and 1 inch. The position of the wall 126, and thereby the gap spacing G2, may be selectively adjusted using an adjustment mechanism 126B (FIG. 4). According to some embodiments, the rear divider wall 126 forms an angle A (FIG. 7) of at least about 30 degrees with respect to horizontal and, according to some embodiments, between about 30 and 45 degrees with respect to horizontal.

The front divider wall 124 and rear divider wall 126 divide the hopper chamber 120 into subchambers or regions. More particularly and referring to FIG. 7, a front region or subchamber 120A is defined between the divider wall 124 and the inlet 116A, an intermediate region or subchamber 120B is defined between the front divider wall 124 and the rear divider wall 126, and a rear region or subchamber 120C is defined between the rear divider wall 126 and the rear wall of the bin 100.

With reference to FIG. 8, the housing 110 further includes a high pressure supply port or nozzle 134. In use, the pressurized gas source 136 is fluidly connected to the high pressure nozzle 134 via a manifold, fitting, flexible or rigid conduit 134A, or the like. The gas source 136 may include a compressor or a container of compressed gas, for example. The high pressure gas source 136 is operative to provide a supply gas flow of a suitable working gas at a high pressure to the nozzle 134. According to some embodiments, the supplied gas is or includes air. According to some embodiments, the pressure of the supplied gas at the nozzle 134 is at least about 10 psi and, according to some embodiments, between about 10 and 60 psi. A flowpath network for the supplied gas is schematically illustrated in FIG. 13 and described below.

Figure 13:
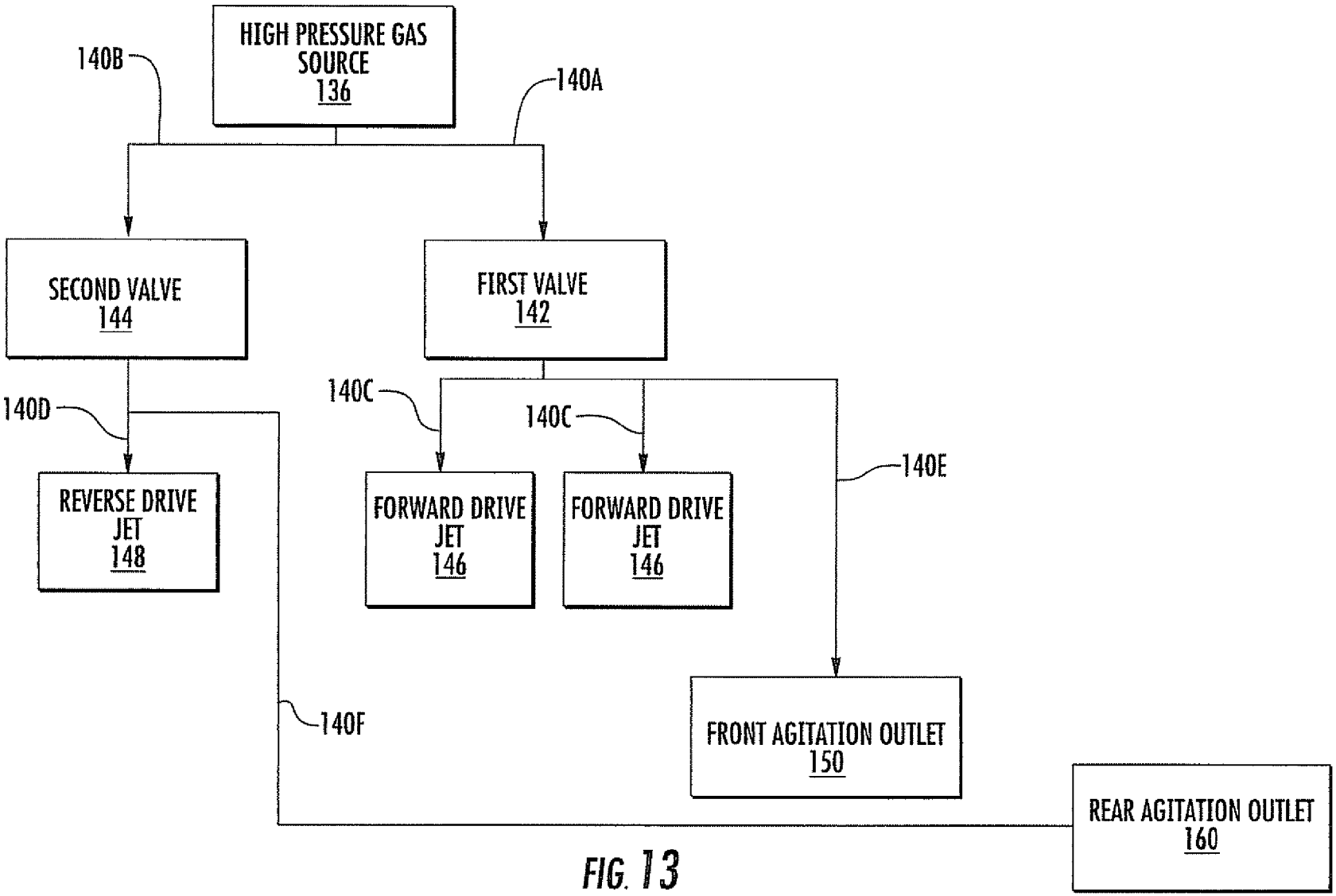
FIG. 13 is a block diagram representing gas supply flow paths of the bin of FIG. 4.

With reference to FIGS. 7, 9 and 13, a gas supply passage or conduit 140A (FIG. 7) fluidly connects the high pressure nozzle 134 to a forward control valve 142. Two forward jet supply passages 140C (FIG. 9) fluidly connect the forward control valve 142 to respective forward drive jet apertures or outlets 146. The forward jet outlets 146 are positioned and configured to direct air or other supplied gas into the dispensing channel 116. A front agitation supply passage 140E (FIG. 9) fluidly connects the forward control valve 142 to a front air amplifier 150. The front air amplifier 150 is positioned and configured to direct air or other supplied gas into the hopper chamber 120 through the front agitation outlet 122C. The forward control valve 142 is operable to control airflow to the forward jet outlets 146 and the front air amplifier 150.

With reference to FIGS. 7, 10, and 13, a gas supply passage or conduit 140B (FIG. 7) fluidly connects the high pressure nozzle 134 to a reverse control valve 144. A reverse jet supply passage 140D (FIG. 10) fluidly connects the reverse control valve 144 to a reverse drive jet aperture or outlet 148. The reverse jet outlet 148 is positioned and configured to direct air or other supplied gas into the dispensing channel 116. A rear agitation supply passage 140F (FIG. 10) fluidly connects the reverse control valve 144 to a rear air amplifier 160. The rear air amplifier 160 is positioned and configured to direct air or other supplied gas into the hopper chamber 120 through the rear agitation outlet 122D. The reverse control valve 144 is operable to control airflow to the reverse jet outlet 148 and the rear air amplifier 160.

The gas supply passages 140A-F may be of any suitable construction and configuration. According to some embodiments, some or all of the passages 140A-F are defined in whole or in part by channels formed in the housing 110. These channels may be machined or molded into the housing 110.

Each of the air amplifiers 150, 160 is secured to the housing 110. The air amplifiers 150, 160 may be of any suitable construction to effect the functionality described herein. According to some embodiments, the air amplifiers 150, 160 are constructed as described below with regard to the air amplifier 150. The air amplifiers 150, 160 may be constructed in the same or similar manners and it will therefore be appreciated that this description can likewise apply to the air amplifier 160 (and/or any additional air amplifiers).

Figure 11:
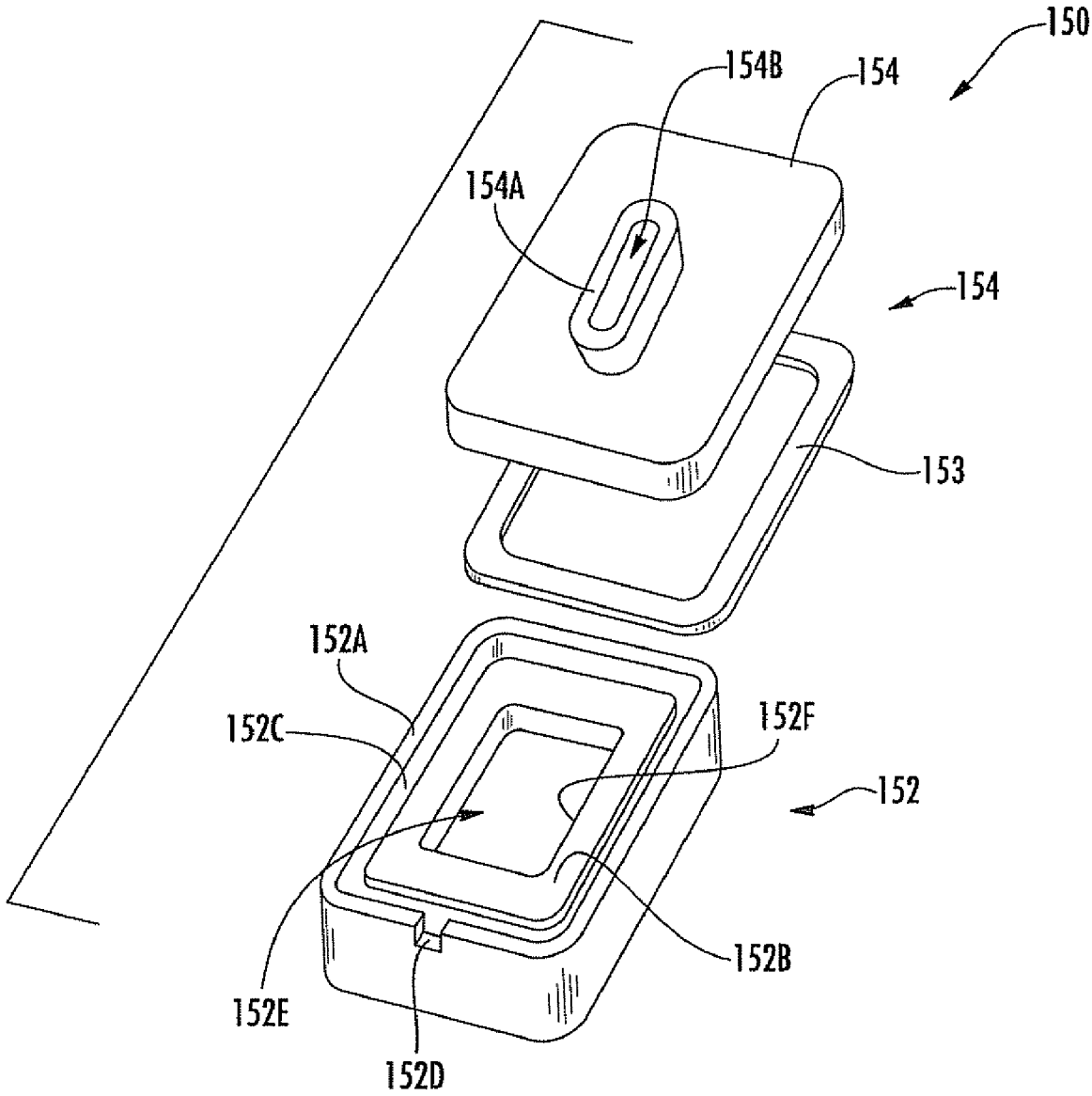
FIG. 11 is an enlarged, exploded, top perspective view of an air amplifier of the bin of FIG. 4.
Figure 12:
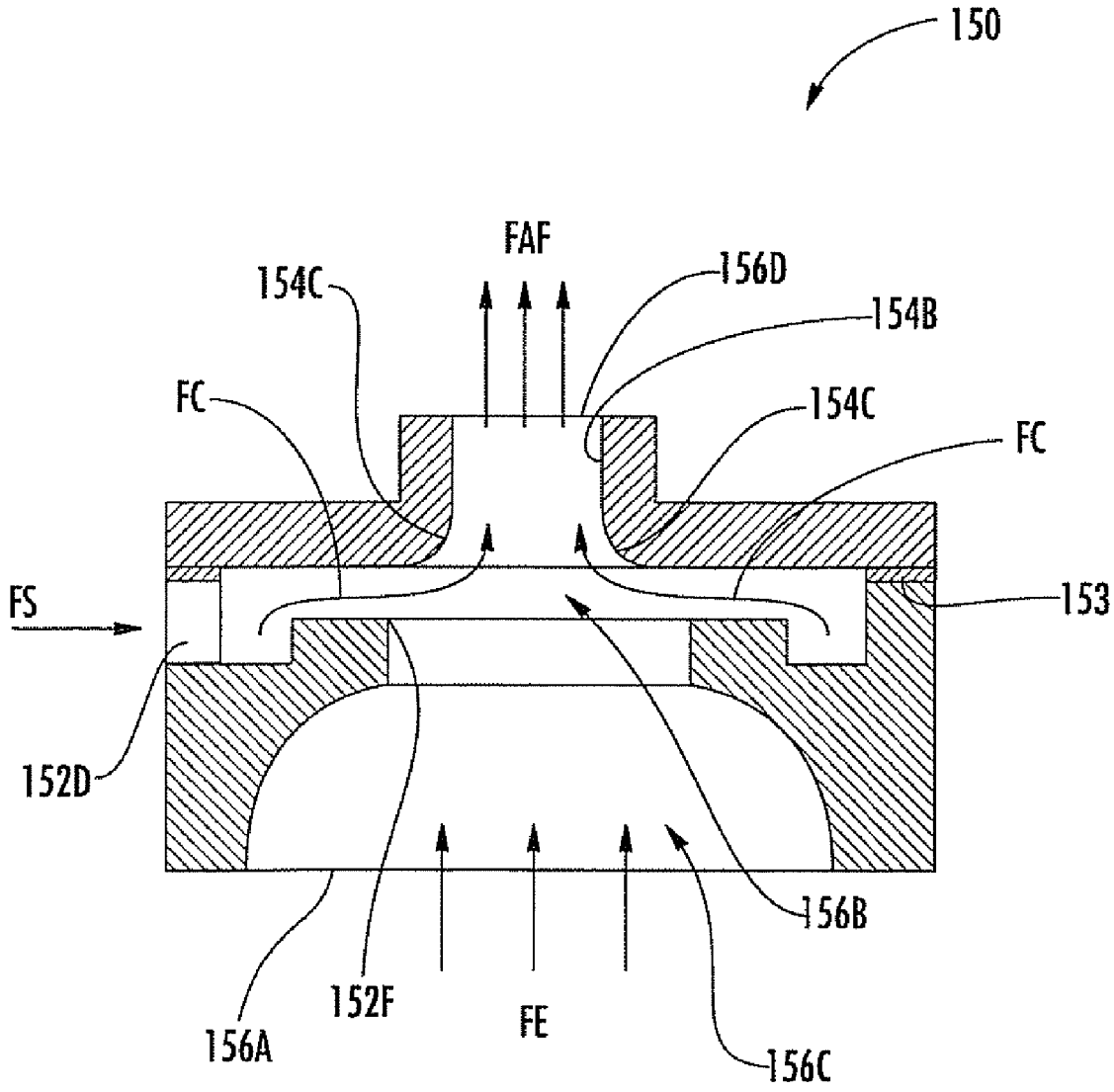
FIG. 12 is a cross-sectional view of the air amplifier of FIG. 10.

With reference to FIGS. 11 and 12, the air amplifier 150 includes an outer body 152, an inner body 154 and a gasket or shim 153. The components 152, 153, 154 may be formed of any suitable material(s). According to some embodiments, the bodies 152, 154 are formed of a rigid polymeric material, which, according to some embodiments, is molded. The shim 153 may also be formed of a rigid polymeric material or, according to other embodiments, an elastomeric material. The bodies 152, 154 may each be unitarily formed as illustrated or may each comprise assembled subcomponents. Moreover, the bodies 152, 154 may be unitarily formed together.

The outer body 152 includes an annular center wall 152A, an annular inner wall 152B, and an annular channel 152C defined therebetween. A feed opening 152D is defined in the wall 152A and fluidly communicates with the channel 152C. When the air amplifier 150 is installed in the housing 110, the gas supply passage 140D (FIG. 7) is fluidly connected to the feed opening 152D to supply the gas from the gas source 136 to the channel 152C. Similarly, when the air amplifier 160 is installed in the housing 110, the gas supply passage 140F is fluidly connected to the feed opening of the air amplifier 160 to supply the gas from the gas source 136 to the annular channel of the air amplifier 160. The body 152 defines a central passage 152E extending up through the wall 152B. The body 152 has a relatively sharp or squared, annular upper edge or corner surface 152F defining a portion of the passage 152E. According to some embodiments, the side and bottom surfaces forming the edge 152F form an angle of about 90 degrees.

The inner body 154 has an upstanding projection or collar 154A. A central passage 154B extends through the inner body 154. The body 154 has a relatively rounded or arcuate, annular lower edge or corner surface 154C defining a portion of the passage 154B.

The components 152, 153, 154 are assembled as shown in FIG. 12 such that the shim 153 is interposed or sandwiched between the bodies 152, 154. The assembled air amplifier 150 has an inlet 156A, an interior chamber 156B, a central passage 156C and an outlet 156D. The interior chamber 156B includes the channel 152C.

In use and with reference to FIG. 12, the air amplifier 150 (and likewise the air amplifier 160) can be used to convert a supplied pressurized gas flow having a given pressure, velocity and mass flow rate into an exiting or output air flow having a comparatively lower pressure, higher velocity, and higher mass flow rate. More particularly, the valve 142 can be opened to supply a flow FS of pressurized as to the channel 152C via the opening 152D. The supplied gas flows around the channel 152C, into the chamber 156B, and into the central passage 156C (as indicated by the arrows FC). The gas flow FC responding to the juxtaposition of the rounded surface 156C opposite and adjacent the sharp corner 152F generally and preferentially follows the rounded surface 154C up through the passage 154B and out through the outlet 156D as a result of the Coanda effect. Due to the Coanda effect, a vacuum or low pressure region is established on or adjacent to the surface 154C. This low pressure region draws a flow of ambient air FE through the inlet 156A. The flow FE is drawn up through the passage 156C and out through the outlet 156C. The two flows FC and FE thereby combine to provide an exit gas flow FAF. The exit gas flow FAF has a pressure that is less than the pressure of the supplied gas FS and a mass flow rate that is greater than that of the supplied gas FS.

The outlet 156D of the air amplifier 150 is positioned in or adjacent the agitation outlet 122C so that the exit gas flow FAF enters the hopper chamber 120 through the outlet 122C. Similarly, the corresponding outlet of the air amplifier 160 is positioned in or adjacent the agitation outlet 122D so that an exit gas flow FAR exiting the air amplifier 160 enters the hopper chamber 120 through the outlet 122D (FIG. 10).

According to some embodiments and as illustrated, one or both of the air amplifiers 150, 160 are mounted on or integrated into the housing 110. The air amplifiers 150, 160 may be separately formed from the housing 110 and secured to the housing by adhesive, fasteners, integral mechanical structures, or the like. All or a portion of each air amplifier 150, 160 may be integrally molded into the housing 110. Each amplifier 150, 160 can be separately formed from the housing 110 and insert molded into the housing 110.

One or more sensors 115 are operatively positioned in the dispensing channel 116. According to some embodiments, the sensors 115 are counting sensors and are operably connected to associated sensor receiver/processor electronics. As further discussed below, the sensors 115 are configured and positioned to detect the tablets T as they pass through the dispensing channel 116. According to some embodiments, the sensors 115 are photoelectric sensors. According to some embodiments, at least one of the sensors includes a photoemitter and the other sensor includes a photodetector that receives photoemissions from the photoemitter of the first sensor.

A connector circuit board or other electrical connector may be mounted on the bin 100 to provide an electrical connection between an external controller and a bin-controlling circuit board or other electronic component of the bin 100 for power and data signals from the external controller and the counting sensors 115.

Exemplary operation of the dispensing system 40 will now be described. The bin 100 is filled with tablets T to be dispensed. The tablets T may initially be at rest as shown in FIG. 8. At this time, the valves 142, 144 are closed so that no gas flow is provided through the jet outlets 146, 148 or the agitation outlets 122C, 122D.

When is it desired to dispense the tablets T to fill the container C, the dispensing carrier 70, directed by the controller 42, moves the container C to the exit port 116B of the selected dispensing bin 100. The controller 42 signals the forward valve 142 to open (while the rearward valve 144 remains closed). The opened valve 142 permits the pressurized gas from the gas source 136 to flow through the passages 140C and out through the forward drive jet outlets 146. The pressurized flow from the jet outlets 146 creates high velocity gas jets that generate suction that causes a forward flow FF of high pressure, high velocity air to be drawn outwardly through the dispensing channel 116 (FIG. 9). Tablets T are oriented into a preferred orientation by the shape of the inlet 116A to the dispensing channel 116 and dispensed into the container C through the dispensing channel 116 and the outlet 116B under the force of the forward flow FF. The counting sensors 115 count the tablets T as they pass through a predetermined point in the dispensing channel 116.

The opening of the valve 142 also simultaneously permits the pressurized supply gas from the gas source 136 to flow through the passage 140E, through the front air amplifier 150 and out through the front agitation outlet 122C as an air flow FAF having a relatively low velocity and high mass flow rate as compared to the gas flow from the jet outlets 146 (FIG. 9). The air flow FAF flows through and lofts or otherwise displaces (i.e., agitates) the tablets T in the front subchamber 120A proximate the inlet 116A. This agitation of the tablets T helps to orient the tablets T for singulated entry into the dispensing channel 116 and to prevent tablet jams. According, to some embodiments, the forward jet as flows and the agitation flow FAF are provided simultaneously.

Once dispensing is complete (i.e., a predetermined number of tablets has been dispensed and counted), the controller 42 activates the forward valve 142 to close and the reverse valve 144 to open. The opened valve 144 permits the pressurized gas from the gas source 136 to flow through the passage 140D and out through the reverse drive jet outlet 148. The pressurized flow from the jet outlet 148 creates a high velocity gas jet that generates suction that causes a reverse (i.e., rearward) flow FR of high pressure air to be drawn inwardly through the dispensing channel 116 toward the chamber 120. In this manner, the airflow is reversed and any tablets T remaining in the channel 116 are returned to the chamber 120 under the force of the reverse flow (FIG. 10).

The opening of the valve 144 also simultaneously permits the pressurized supply gas from the gas source 136 to flow through the passage 140F, through the rear air amplifier 160 and out through the rear agitation outlet 122D as the air flow FAR which has a relatively low velocity and high mass flow rate as compared to the gas flow from the jet outlet 148 (FIG. 10). The air flow FAR flows through and lofts or otherwise displaces (i.e., agitates) the tablets T in the front subchamber 120A and/or the intermediate subchamber 120B proximate the choke point 124A. This agitation of the tablets T helps to loosen the tablets T to permit return of the tablets T and to prevent or break tablet jams. According to some embodiments, the reverse jet gas flow and the agitation flow FAR are provided simultaneously. According to some embodiments, the reverse valve 144 is opened and then closed after a relatively short period to provide the reverse flow FR and the agitation flow FAR as short bursts.

During a dispensing cycle, the controller 42 may determine that a tablet jam condition is or may be present. Tablets may form a jam at the nozzle inlet 116A, the choke point 124A or the choke point 126A, so that no tablets are sensed passing through the dispensing passage 116 for a prescribed period of time while the forward air flow FF is being generated. In this case, the controller 42 will issue a "backjet" by closing the forward valve 142 and opening the reverse valve 144 as described above for generating the air flows FR, FAR. The air flows FR, FAR may serve to dislodge any jams at the inlet 116A, the choke point 124A, or the choke point 126A as well as to loosen the tablets in the subchamber 120C.

According to some embodiments and as illustrated, the drive jet outlets 146 and the agitation outlet 122C (and/or the drive jet outlet 148 and the agitation outlet 122D) are fluidly connected to the pressurized gas source via the same intake (i.e., the nozzle 134). According to some embodiments and as illustrated, only a single gas source 136 is used to supply both the drive jet outlets 146 and the agitation outlet 122C or both the drive jet outlet 148 and the agitation outlet 122D. According to some embodiments, a single gas source is used to supply all drive jet outlets and agitation outlets.

According to some embodiments, the pressure of the gas supplied to the feed inlet 152D of each air amplifier 150, 160 is substantially the same as the pressure of the gas supplied to each drive jet outlet 146, 148.

In the foregoing manner, agitation air flows FAF, FAR can be provided to facilitate effective and reliable dispensation and return of the tablets T. The air amplifiers 150, 160 may enable effective agitation of tablets in the hopper 120 using a supplied gas flow that would otherwise be insufficient. For example, a compressor having a lower mass flow rate supply capacity may be used for the gas source 136. This may be particularly beneficial where a smaller or quieter compressor may be needed or desired (e.g., in a pharmacy).

Because the air flows FAF, FAR are supplied from a high pressure source suitable to supply the drive jet outlets 146, 148, it is not necessary to provide a separate low pressure, high mass flow rate air supply to perform tablet agitation and, therefore, the associated apparatus (e.g., manifolds, pumps, etc.) can be omitted. Moreover, because the air flows FAF, FAR are supplied from a common (i.e., the same) high pressure gas source 136 as the jets 144, 146, the number of supplies and connections required can be reduced or minimized. As a result, dispensing systems and bins according to embodiments of the present invention may be less expensive and complicated to manufacture and operate.

The divider walls 124, 126 and choke points 124A, 126A may further facilitate smooth and reliable operation of the bin 100, while also allowing for filling the bin 100 with a greater number of tablets. With reference to FIG. 8, the choke points 124A, 126A limit or reduce the weight load that tends to push the tablets forward into the front or staging region 120A. As a result, fewer tablets T tend to collect in the region 120A so that fewer tablets T must be displaced by the air flow FAF from the air amplifier 150. Thus, by reducing the tablet load, the bin 100 may be able to effectively agitate the tablets and prevent jams with lower air flow energy from the air amplifier 150. The sizes of the choke points 124A, 126A may be selectively adjusted by raising and lowering the divider walls 124, 126 to customize the bin 100 for dispensing tablets of different sizes, for example.

The angled orientation of the divider wall 126 with respect to vertical also serves to reduce the forward loading on the tablets T. The angled divider wall 126 may thereby permit a larger amount of tablets to be stored in the hopper chamber 120.

The arrangement of the divider walls 124, 126 may also serve to promote dispensing of the oldest tablets (i.e., the tablets that have been in the hopper chamber 120 longest) first. Generally, newer tablets are added on top of older tablets in the subchamber 120C. Once the bottommost tablets pass through the choke point 126A, they tend not to return to the subchamber 120C even when a backjet is executed.

The air amplifiers 150, 160 can be tuned or adjusted to provide the desired performance in view of other operating parameters (e.g., tablet size, supplied gas flow rate, etc.). One method in accordance with the present invention for adjusting an air amplifier 150, 160 is to replace the shim 153 with a shim that is thicker or thinner, depending on the desired adjustment. The described methods of assembly and adjustment may allow for a relatively low profile air amplifier.

While the bin 100 has been illustrated and described herein with only one front air amplifier 150 and one rear air amplifier 160, fewer or greater numbers of front and rear air amplifiers may be provided. For example, there may be two or more front air amplifiers 150 and/or two or more rear air amplifiers 160. According to some embodiments, the bin may include only a front air amplifier or air amplifiers 150 or, alternatively, only one or more rear air amplifiers 160. The air amplifiers may be arranged and configured in any suitable manner. For example, a row or rows of air amplifiers may extend across the width of the floor 122.

While the bin 100 has been illustrated and described herein with the air amplifier 150 being supplied from the same valve 142 and controlled in group fashion with the drive jet outlets 146 and the air amplifier 160 being supplied from the same valve 144 and controlled in group fashion with the drive jet outlet 148, one or both of the air amplifiers 150, 160 can be separately controlled from the associated jet outlets. For example, a further valve may be provided that controls the gas supply to the air amplifier 150 independently of the jet outlets 146, whereby the tablets T may be agitated via the air amplifier 150 prior to providing the dispensing draw via the jet outlets 146.

According to some embodiments, the agitation outlets 122C, 122D are each sized and shaped such that tablets of the size and shape intended to be dispensed using the bin cannot fall through the outlet 122C, 122D. According to some embodiments and as illustrated, one or both of the agitation outlets 122C, 122D is an elongated slot. Such a shape may serve to prevent a tablet from settling over so much of the area of the outlet 122C, 122D that the Coanda effect is defeated. According to some embodiments, each elongated outlet 122C, 122D has a width of no more than about 2 mm. According to some embodiments, each elongated outlet 122C, 122D has an area of at least about 0.24 $in^2$.

While, in the foregoing description, the valves 142, 144 are controlled by the controller 42, the valves 142, 144 may alternatively be controlled by a local controller unique to each bin 100.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. An apparatus for dispensing pharmaceutical articles, the apparatus comprising:

a) a housing defining:

a hopper chamber to hold the articles;

a dispensing channel fluidly connected to the hopper chamber, the dispensing channel having an inlet and an outlet and defining a flow path therebetween;

a drive jet outlet; and an agitation outlet; and b) a gas source to provide a positive pressure supply gas flow, wherein the gas source is fluidly connected to each of the drive jet outlet and the agitation outlet to provide:

a pressurized drive jet gas flow through the drive jet outlet to convey articles through the dispensing channel along the flow path; and a pressurized agitation gas flow through the agitation outlet to agitate articles in the hopper chamber;

wherein the agitation gas flow has a greater mass flow rate than the drive jet gas flow; and wherein the apparatus is configured to generate the drive jet gas flow and the agitation gas flow simultaneously using the same gas source.

2. The apparatus of claim 1 wherein the agitation gas flow has a greater mass flow rate than the supply gas flow.

3. The apparatus of claim 2 including an air amplifier interposed and fluidly connected between the gas source and the agitation outlet.

4. The apparatus of claim 3 wherein the air amplifier is integrated into the housing.

5. The apparatus of claim 3 wherein the air amplifier is configured to utilize the Coanda Effect.

6. The apparatus of claim 5 wherein the agitation outlet is elongated.

7. The apparatus of claim 1 wherein:

the housing further includes a second agitation outlet; and the gas source is fluidly connected to the second agitation outlet to provide a second pressurized agitation gas flow through the second agitation outlet to agitate articles in the hopper chamber.

8. The apparatus of claim 7 wherein:

the housing includes a divider wall configured to define, in the hopper chamber, a front region between the inlet and the divider wall and a rear region on a side of the divider wall opposite the front region, and to further form a choke passage between the front and rear regions;

the agitation outlet is a first agitation outlet and the agitation gas flow is a first agitation gas flow;

the first agitation outlet is positioned and configured to direct the first agitation gas flow into the front region to agitate articles in the front region; and the second agitation outlet is positioned and configured to direct the second agitation gas flow into the rear region to agitate articles in the rear region.

9. The apparatus of claim 8 wherein:

the drive jet gas flow is operative to convey the articles through the dispensing channel in a forward direction toward the outlet; and the apparatus includes at least one valve operable to simultaneously provide the drive jet gas flow through the drive jet outlet and the first agitation gas flow through the first agitation outlet to dispense articles from the hopper chamber.

10. The apparatus of claim 8 wherein:

the drive jet gas flow is operative to convey the articles through the dispensing channel in a reverse direction toward the inlet; and the apparatus includes at least one valve operable to simultaneously provide the drive jet gas flow through the drive jet outlet and the second agitation gas flow through the second agitation outlet.

11. The apparatus of claim 8 wherein a spacing between the divider wall and a floor of the housing is adjustable to adjust the size of the choke passage.

12. The apparatus of claim 8 wherein the divider wall is angled with respect to vertical to support a load of the articles in the rear region.

13. The apparatus of claim 8 wherein the housing is configured to direct tablets through the choke passage from the rear region to the front region.

14. The apparatus of claim 13 wherein the housing further includes a second divider wall configured to divide the rear region into a first rear region between the first and second divider walls and a second rear region on a side of the second divider wall opposite the first rear region, the second divider wall forming a second choke passage between the first and second rear regions, wherein the housing is configured to direct tablets through the second choke passage from the second rear region to the first rear region and thereafter from the first rear region to the front region.

15. The apparatus of claim 1 wherein:

the drive jet gas flow is operative to convey the articles through the dispensing channel in a reverse direction toward the inlet; and the apparatus includes a controller operative to simultaneously provide the drive jet gas flow through the drive jet outlet and the agitation gas flow through the agitation outlet responsive to a tablet jam condition.

16. The apparatus of claim 1 wherein the housing includes a floor and a divider wall configured to define, in the hopper chamber:

a front region between the inlet and the divider wall;

a rear region on a side of the divider wall opposite the front region; and a choke passage between the front and rear regions and between the divider wall and the floor;

wherein a spacing between the divider wall and the floor is adjustable to adjust the size of the choke passage.

17. The apparatus of claim 16 wherein the housing further includes a second divider wall configured to divide the rear region into a first rear region between the first and second divider walls and a second rear region on a side of the second divider wall opposite the first rear region, the second divider wall forming a second choke passage between the first and second rear regions and between the second divider wall and the floor, wherein the housing is configured to direct tablets through the second choke passage from the second rear region to the first rear region and thereafter from the first rear region to the front region.

18. The apparatus of claim 16 wherein the agitation outlet is positioned and configured to direct a gas flow from the gas source into at least one of the front region and the rear region to agitate articles therein.

19. The apparatus of claim 16 wherein the divider wall is angled with respect to vertical to support a load of the articles in the rear region.

20. The apparatus of claim 1 wherein:

the housing includes a divider wall configured to define, in the hopper chamber, a front region between the inlet and the divider wall and a rear region on a side of the divider wall opposite the front region, and to further form a choke passage between the front and rear regions;

the housing further includes a second agitation outlet and the gas source is fluidly connected to the second agitation outlet to provide a second pressurized agitation gas flow through the second agitation outlet to agitate articles in the hopper chamber;

the drive jet outlet is a forward drive jet outlet and the drive jet gas flow is a forward drive jet gas flow;

the housing further includes a reverse drive jet outlet and the gas source is fluidly connected to the reverse drive jet outlet to provide a reverse drive jet gas flow through the reverse drive jet outlet to convey articles through the dispensing channel along the flow path;

the agitation outlet is a first agitation outlet and the agitation gas flow is a first agitation gas flow;

the first agitation outlet is positioned and configured to direct the first agitation gas flow into the front region to agitate articles in the front region;

the second agitation outlet is positioned and configured to direct the second agitation gas flow into the rear region to agitate articles in the rear region;

the forward drive jet gas flow is operative to convey the articles through the dispensing channel in a forward direction toward the outlet;

the reverse drive jet gas flow is operative to convey the articles through the dispensing channel in a reverse direction toward the inlet; and the apparatus is operative to alternate between a forward mode and a reverse mode, wherein:

in the forward mode, the apparatus simultaneously provides the forward drive jet gas flow through the forward drive jet outlet and the first agitation gas flow through the first agitation outlet to dispense articles from the hopper chamber while not providing the reverse drive jet gas flow and the second agitation gas flow; and in the reverse mode, the apparatus simultaneously provides the reverse drive jet gas flow through the reverse drive jet outlet and the second agitation gas flow through the second agitation outlet to return articles to the hopper chamber while not providing the forward drive jet gas flow and the first agitation gas flow.

21. A method for dispensing pharmaceutical articles, the method comprising:

a) providing an apparatus including:

1) a housing defining:

a hopper chamber to hold the articles;

a dispensing channel fluidly connected to the hopper chamber, the dispensing channel having an inlet and an outlet and defining a flow path therebetween;

a drive jet outlet; and an agitation outlet; and 2) a gas source to provide a positive pressure supply gas flow, wherein the gas source is fluidly connected to each of the drive jet outlet and the agitation outlet; and b) providing the positive pressure supply gas flow from the gas source to each of the drive jet outlet and the agitation outlet to simultaneously generate, using the same gas source, each of a pressurized drive jet gas flow through the drive jet outlet and a pressurized agitation gas flow through the agitation outlet, wherein the drive jet gas flow conveys articles through the dispensing channel along the flow path and the agitation gas flow agitates articles in the hopper chamber;

wherein the agitation gas flow has a greater mass flow rate than the drive jet gas flow.

22. The method of claim 21 wherein the agitation gas flow has a greater mass flow rate than the supply gas flow.

23. The method of claim 21 including providing the supply gas flow from the gas source to the agitation outlet via an air amplifier interposed and fluidly connected between the gas source and the agitation outlet.

24. The method of claim 23 wherein the air amplifier is configured to utilize the Coanda Effect.

25. The method of claim 21 further including providing the positive pressure gas from the gas source to a second agitation outlet in the housing to generate a second pressurized agitation gas flow through the second agitation outlet to agitate articles in the hopper chamber.

26. The method of claim 25 wherein the agitation gas flow is a first agitation gas flow, the method including:

providing a divider wall configured to define, in the hopper chamber, a front region between the inlet and the divider wall and a rear region on a side of the divider wall opposite the first region, and to further form a choke passage between the front and rear regions;

directing the first agitation gas flow into a front region to agitate articles in the front region; and directing the second agitation gas flow into the rear region to agitate articles in the rear region.

27. The method of claim 26 including:

conveying the articles through the dispensing channel in a forward direction toward the outlet using the drive jet gas flow; and providing the drive jet gas flow through the drive jet outlet and the first agitation gas flow through the first agitation outlet simultaneously to dispense articles from the hopper chamber.

28. The method of claim 26 including:

conveying the articles through the dispensing channel in a reverse direction toward the inlet using the drive jet gas flow; and providing the drive jet gas flow through the drive jet outlet and the second agitation gas flow through the second agitation outlet simultaneously.

29. The method of claim 21 including:

detecting a tablet jam condition; and in response to the tablet jam condition, generating the drive jet gas flow and the agitation gas flow, wherein the drive jet gas flow is operative to convey the articles through the dispensing channel in a reverse direction toward the inlet.

30. The method of claim 21 wherein:

the housing includes a divider wall configured to define, in the hopper chamber, a front region between the inlet and the divider wall and a rear region on a side of the divider wall opposite the front region, and to further form a choke passage between the front and rear regions;

the housing further includes a second agitation outlet and the gas source is fluidly connected to the second agitation outlet to provide a second pressurized agitation gas flow through the second agitation outlet to agitate articles in the hopper chamber;

the drive jet outlet is a forward drive jet outlet and the drive jet gas flow is a forward drive jet gas flow;

the housing further includes a reverse drive jet outlet and the gas source is fluidly connected to the reverse drive jet outlet to provide a reverse drive jet gas flow through the reverse drive jet outlet to convey articles through the dispensing channel along the flow path;

the agitation outlet is a first agitation outlet and the agitation gas flow is a first agitation gas flow;

the first agitation outlet is positioned and configured to direct the first agitation gas flow into the front region to agitate articles in the front region;

the second agitation outlet is positioned and configured to direct the second agitation gas flow into the rear region to agitate articles in the rear region;

the forward drive jet gas flow is operative to convey the articles through the dispensing channel in a forward direction toward the outlet;

the reverse drive jet gas flow is operative to convey the articles through the dispensing channel in a reverse direction toward the inlet; and the method includes alternating between a forward mode and a reverse mode, wherein:

in the forward mode, the apparatus simultaneously provides the forward drive jet gas flow through the forward drive jet outlet and the first agitation gas flow through the first agitation outlet to dispense articles from the hopper chamber while not providing the reverse drive jet gas flow and the second agitation gas flow; and in the reverse mode, the apparatus simultaneously provides the reverse drive jet gas flow through the reverse drive jet outlet and the second agitation gas flow through the second agitation outlet to return articles to the hopper chamber while not providing the forward drive jet gas flow and the first agitation gas flow.

* * * * *